United States Patent [19]

Watanabe

[11] Patent Number: 4,518,128

[45] Date of Patent: May 21, 1985

[54] CORRECTION TAPE TAKE-UP SPOOL ASSEMBLY FOR TYPEWRITER

[76] Inventor: Hiroaki Watanabe, 1526-17, Shinyoshida-machi, Kohoku-ku, Yokohama-shi, Kanagawa-kin,233, Japan

[21] Appl. No.: 530,486

[22] Filed: Sep. 9, 1983

[30] Foreign Application Priority Data

Sep. 13, 1982 [JP] Japan ..... 57-138731

[51] Int. Cl.[3] ..... B65H 75/18

[52] U.S. Cl. ..... 242/71.8; 242/118.61

[58] Field of Search ..... 242/71.8, 71.9, 118.4–118.8, 242/68; 400/242–246

[56] References Cited

U.S. PATENT DOCUMENTS

| | | | |
|---|---|---|---|
| 3,132,821 | 5/1964 | Herden | 242/68 |
| 3,522,917 | 8/1970 | Fryc | 242/197 |
| 3,779,476 | 12/1973 | Hofbauer | 242/67.3 |

*Primary Examiner*—Leonard D. Christian

*Attorney, Agent, or Firm*—Thomas L. Tully

[57] ABSTRACT

A correction tape take-up spool assembly for typewriter comprising a spool member provided with a rotating means for winding up a correction tape; a bobbin member on which the correction tape is wound up and which is capable to serve as a correction tape feed bobbin, the bobbin member being detachably received outwardly on the bobbin receiving portion of the spool member; and a means for preventing a relative rotation between the spool member and the bobbin member; and the bobbin member being received on the bobbin receiving portion in such a manner that the position of the bobbin member is reverse to the position in case that the bobbin member is used as a correction tape feed bobbin. The correction tape can be reused by detaching the bobbin member on which the correction tape used is wound from the spool member, and using the bobbin member with the correction tape as a tape feed bobbin and setting another empty bobbin member on the spool member.

8 Claims, 10 Drawing Figures

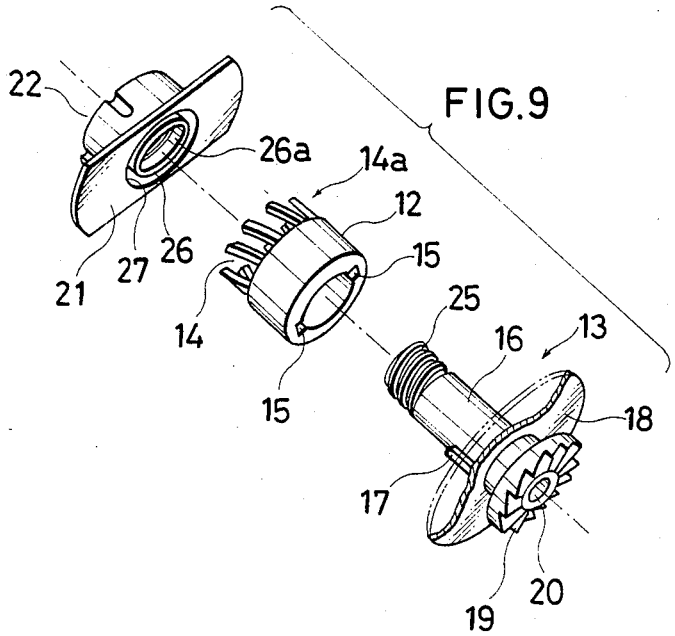
FIG. 9
FIG. 10
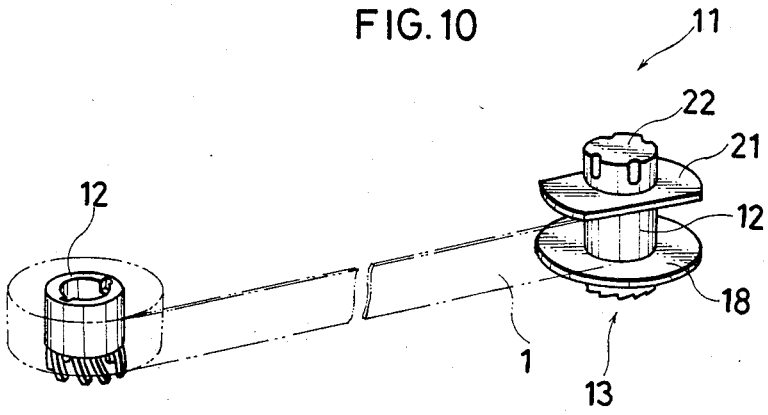

CORRECTION TAPE TAKE-UP SPOOL ASSEMBLY FOR TYPEWRITER

BACKGROUND OF THE INVENTION

The present invention relates to improvements in the take-up spool which winds up a correction tape for lifting off mistyped characters from a paper by means of the adhesive material applied on the correction tape for a typewriter.

The correction tape is generally used in such a manner that the free end of the correction tape wound on a bobbin is extended to the reel portion of a take-up spool and the take-up spool is rotated intermittently by means of the typewriter mechanism to take up the correction tape on the reel portion of the take-up spool.

In a conventional arrangement, as shown in FIGS. 1 and 2, a bobbin 2 on which a correction tape 1 is wound is cylinder-shaped and has helical slits 4 over the circumference of the bottom portion thereof. The bobbin 2 is mounted rotatably on the holding shaft (not shown) of typewriter mechanism so that the helical slits 4 of the bobbin 2 are in mesh engagement with the spring member (not shown) secured to the holding shaft, whereby the free rotation of the bobbin 2 in the direction of arrow a is hindered to ensure a proper tape tension.

A take-up spool 3 has a tape reel portion 7 at the intermediate portion thereof defined by an upper flange 5 and a lower flange 6; a knob 8 on the upper flange 5; a ratchet gear 9 formed at the bottom of the lower flange 6; and an engaging hole 10 formed extending from the central portion of the ratchet gear 9 to the inside of the reel portion 7. The take-up spool 3 is rotatably mounted on the holding shaft (not shown) of typewriter mechanism so that the holding shaft is inserted into the engaging hole 10. The ratchet gear 9 is brought into mesh engagement with the jaw clutch (not shown) of a typewriter mechanism, whereby the spool 3 is rotated intermittently.

With the conventional bobbin 2 and spool 3 for the correction tape 1, since their rotation mechanisms are significantly different from each other as described above. it is not allowed to exchange the supporting position of the bobbin 2 for that of the take-up spool 3 for reusing the correction tape 1 as in case of ordinary typing ribbon spools. Thus, the correction tape 1 is a throwaway one in the conventional technique. If it is desired to reuse the correction tape 1 for economy's sake, the correction tape 1 wound up on the spool 3 must be manually re-reeled on the bobbin 2, requiring a laborious procedure.

It is an object of the present invention to provide a correction tape take-up spool for typewriter which is constructed so that the correction tape can be reused without re-reeling the correction tape wound up on the spool on a bobbin.

This and other objects of the present invention will become apparent from the description hereinafter.

SUMMARY OF THE INVENTION

In accordance with the present invention, there is provided a correction tape take-up spool for typewriter comprising a spool member provided with a rotating means for winding up a correction tape: a bobbin member on which. the correction tape is wound up and which is capable to serve as a correction tape feed bobbin, the bobbin member being detachably received outwardly on the bobbin receiving portion of the spool member; and a means for preventing a relative rotation between the spool member and the bobbin member; and the bobbin member being received on the bobbin receiving portion in such a manner that the position of the bobbin member is reverse to the position in case that the bobbin member is used as a correction tape feed bobbin.

BRIEF DESCRIPTION OF THE DRAWINGS

FIG. 9 is an exploded perspective view of the take-up spool, and FIG. 10 is a perspective view showing the take-up spool together with a bobbin member used as a tape feed bobbin.

DETAILED DESCRIPTION

The correction tape take-up spool of the present invention is used in such a manner as follows:

A bobbin member on which a new correction tape is wound is used as a correction tape feed bobbin. Another bobbin member on which no correction tape is wound is attached to a spool member. The spool member with the empty bobbin member is used for winding up the correction tape wound off from the bobbin member as the correction tape feed bobbin. The correction tape is wound up on the bobbin member of the take-up spool in the same direction that a new correction tape is wound up on the bobbin member as the correction tape feed bobbin, since the bobbin member is received on the spool member in such a manner that its position is reverse to the position of the bobbin member used as the correction tape feed bobbin. Therefore, after the correction tape has been wound up completely on the bobbin member of the take-up spool, the bobbin member with the correction tape is detached from the take-up spool and can be exchanged as it is for the bobbin member as the correction tape feed bobbin which is now empty, whereby the correction tape can be reused. Thus, the economy in materials and expenses can be achieved according to the present invention.

The present invention will be explained by referring to the accompanying drawings.

Figure 1:
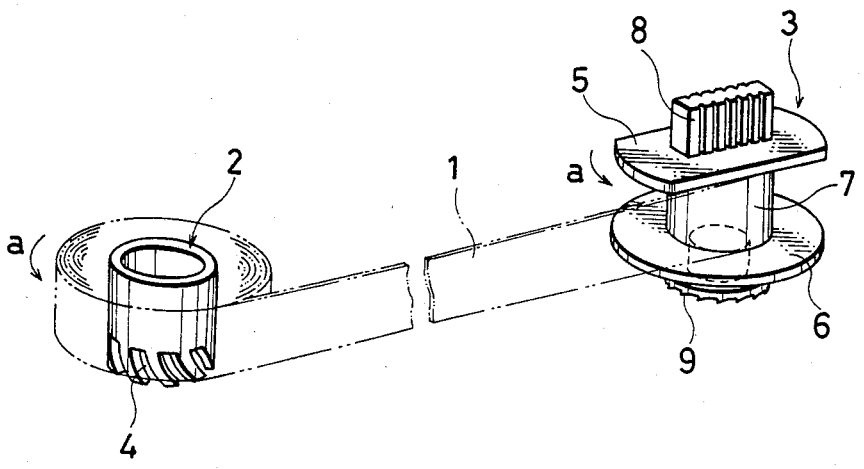
FIG. 1 is a perspective view showing a take-up spool and a bobbin for correction tape used in a conventional technique.
Figure 2:
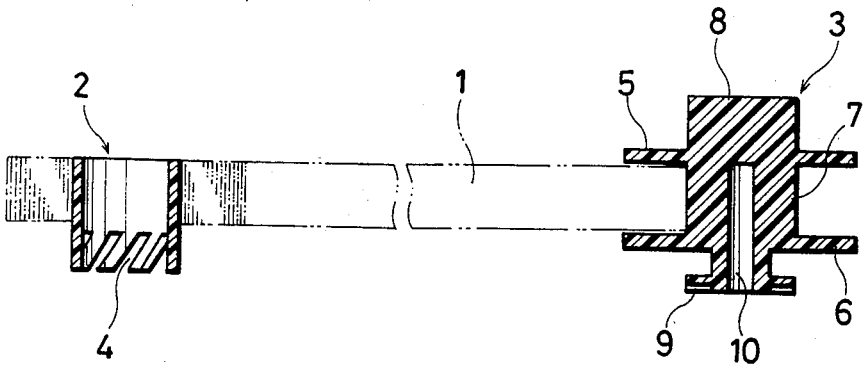
FIG. 2 is a longitudinal sectional view of FIG. 1.
Figure 3:
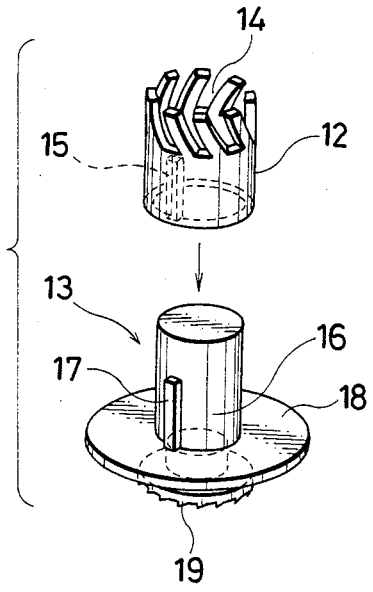
FIG. 3 is an exploded perspective view showing an embodiment of the take-up spool in accordance with the present invention.
Figure 4:
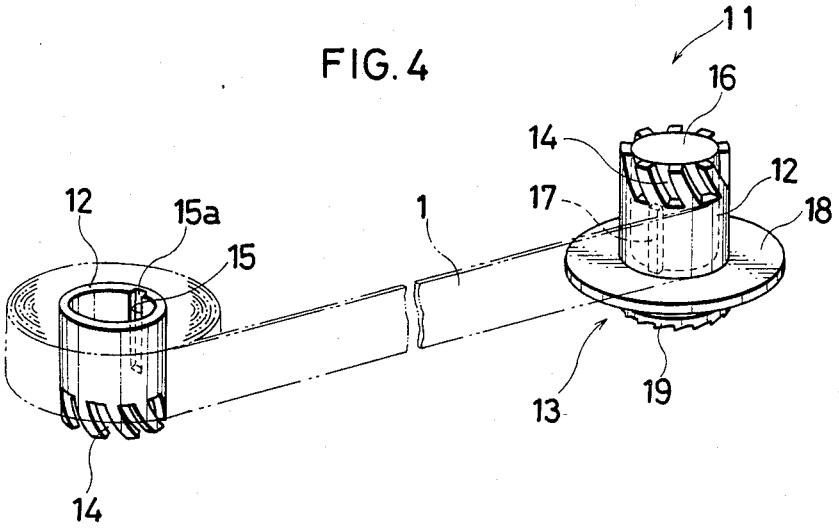
FIG. 4 is a perspective view showing the take-up spool together with a bobbin member used as a tape feed bobbin.
Figure 5:
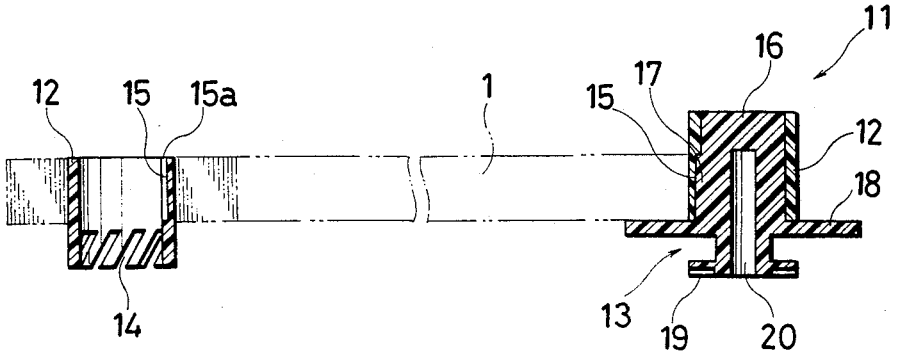
FIG. 5 is a longitudinal sectional view of FIG. 4.

FIGS. 3, 4 and 5 show an embodiment of the take-up spool of the present invention (this embodiment is hereinafter referred to as "Embodiment I").

A take-up spool 11 in accordance with the present invention is composed of a bobbin member 12 and a spool shaft member 13.

The bobbin member 12 has a hollow cylindrical shape as a whole and helical slits 14 formed over the circumference of the lower portion thereof. The term "lower portion" means the lower portion of the bobbin member in the position that the bobbin member 12 is mounted on the holding shaft (not shown) of typewriter mechanism as a correction tape feed bobbin as shown at the left side of FIGS. 4 and 5 (this position of the bobbin member 12 is referred to as "tape feed side position"). The bobbin member 12 has a groove 15 extending in the longitudinal direction thereof on the internal wall thereof. The one end 15*a* of the groove 15 is made open at the upper end of the bobbin member 12 with respect to the tape feed side position.

The spool member 13 has a bobbin receiving portion 16 with a cylindrical shape and receives the bobbin member 12 outwardly on the bobbin receiving portion 16 so that the position of the bobbin member 12 is reverse to the tape feed side position, as shown in FIG. 3 and at the right side of FIGS. 4 and 5. The bobbin receiving portion 16 has a projection 17 extending in the longitudinal direction thereof on the surface thereof and engaging with the groove 15 of the bobbin member 12.

The spool member 13 has a first flange 18 for defining the position of the correction tape 1 being wound up on the bobbin member 12 and integrally formed at the lower end of the bobbin receiving portion 16. The spool member 13 has a hole 20 fitting the driving means of typewriter mechanism and which extends lengthwise from the bottom of the member 13 to the inside thereof and a ratchet gear 19 engaging with the driving means and which is formed integrally at the bottom of the member 13.

The bobbin member 12 is received outwardly on the bobbin receiving portion 16 of the spool member 13 so that the projection 17 of the spool member 13 is engaged with the groove 15 of the bobbin member 12, whereby preventing the relative rotation between the bobbin member 12 and the spool member 13. The take-up spool 11 thus assembled is used in the same manner as with the conventional take-up spool to wind up the correction tape 1, which is wound off from the bobbin member 12 as a tape feed bobbin, on the bobbin member 12 held on the spool member 13. After the correction tape 1 is completely wound up on the take-up spool 11, the bobbin member 12 on which the correction tape 1 is now wound is detached from the spool member 13 and then exchanged for the bobbin member 12 used as the tape feed bobbin which is now empty. The empty bobbin member 12 is set on the spool member 13 with the position of the bobbin member 12 being reverse to the position in case that it is used as a tape feed bobbin. The thus assembled take-up spool 11 is again used for winding up the correction tape 1.

Figure 6:
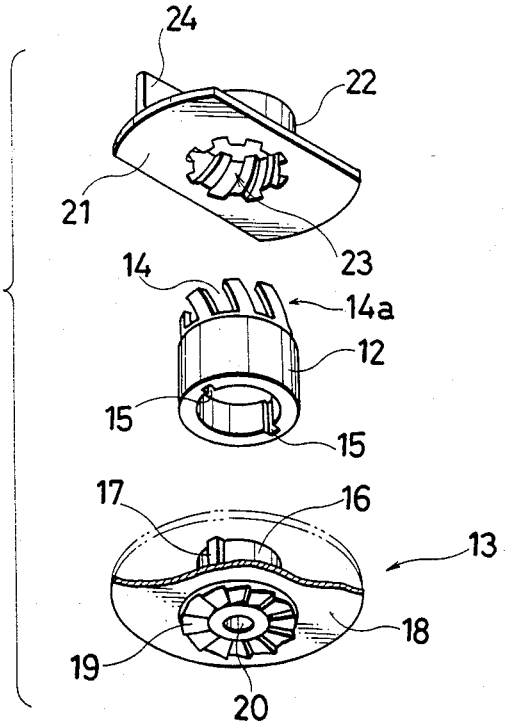
FIG. 6 is an exploded perspective view showing another embodiment of the take-up spool in accordance with the present invention.
Figure 7:
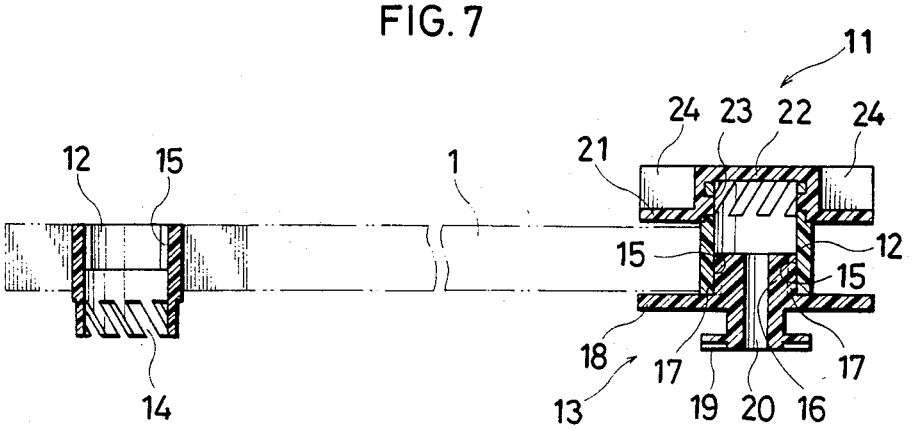
FIG. 7 is a sectional view showing the take-up spool together with a bobbin member used as a tape feed bobbin.

FIGS. 6 and 7 show another embodiment of the take-up spool of the present invention (this embodiment is hereinafter referred to as "Embodiment II"). In FIGS. 6 and 7, the same reference numerals as in Embodiment I (FIGS. 3, 4 and 5) will be used to identify the corresponding components.

The take-up spool of Embodiment II is constructed so that a second flange member 21 engaging with the bobbin member 12 is used to wind up correctly the correction tape 1 with preventing it from moving up and down in cooperation with the first flange 18 of the spool member 13, whereby causing no trouble in winding off the correction tape 1 from the bobbin member 12 used as a tape feed bobbin.

The second flange member 21 has a boss portion 22 formed at the central portion of the member 21. The boss portion 22 has a grooved bore 23 therein which is brought into mesh engagement with the helical slits 14 of the bobbin member 12. The second flange member 21 has a rib 24 formed integrally on the upper surface thereof and the rib 24 serves as a grip and a reinforcement. As shown in FIG. 7, the second flange member 21 is detachably joined with the lower portion 14*a* (with respect to the tape feed position) of the bobbin member 12 set on the spool member 13 so that the grooved bore 23 is meshed with the helical slits 14.

Figure 8:
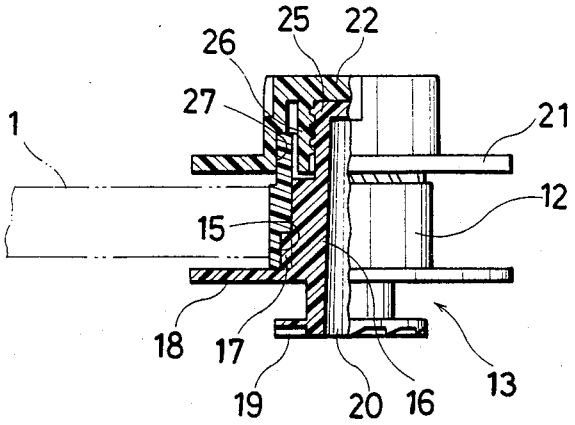
FIG. 8 is an elevational view partly in longitudinal section showing a still another embodiment of the take-up spool in accordance with the present invention.

FIGS. 8, 9 and 10 show still another embodiment of the take-up spool of the present invention (this embodiment is hereinafter referred to as "Embodiment III"). In FIGS. 8, 9 and 10, the same reference numerals as in Embodiment I (FIGS. 3, 4 and 5) and Embodiment II (FIGS. 6 and 7) will be used to identify the corresponding components.

The take-up spool of Embodiment III is constructed so that a second flange member 21 is detachably secured to the spool member 13, whereby any accidental displacement of the bobbin member 12 and the second flange member 21 during winding up the correction tape 1 is prevented.

The second flange member 21 has a sleeve portion 26 formed integrally in the inside of the boss portion 22 and the sleeve portion 26 has a helically threaded bore 26*a*. The boss portion 22 has also a cylindrical groove 27 for receiving the lower portion 14*a* (with respect to the tape feed position) of the bobbin member 12 having the helical slits 14 and formed around the sleeve portion 26. The spool member 13 has an extended portion 25 at the upper end thereof and the extended portion 25 is threaded outwardly.

The extended portion 25 of the spool member 13 which has received the bobbin member 12 thereon is threadably inserted into the sleeve portion 26 of the second flange member 21, thereby joining securely the second flange member 21 with the spool member 13. Thus, the take-up spool of Embodiment III is assembled as shown in FIG. 8. In this case, when the helical slit portion 14*a* of the bobbin member 12 is inserted in the cylindrical groove 27 of the second flange member 21 and pressed lengthwise, the helical slit portion 14*a* functions as a spring washer with respect to the sleeve portion 26 by means of the resilient repulsion of the helical slit portion 14*a*, thereby preventing the thread engagement between the sleeve portion 26 and the extended portion 25 from loosening.

In accordance with Embodiments I, II and III mentioned above, the correction tape 1 may be used repeatedly as it is for reuse of it. However, it is more advantageous for ensured correction of mistyped characters that the correction tape 1 is widened and is used in such a manner that the lower half of the tape is used for the first time and then the upper half of the tape is used for the second time. In that case, of course, the bobbin member 12 and the spool member 13 are constructed so that they can be adapted to the widened correction tape 1.

In accordance with the present invention, the correction tape 1 can be reused only by detaching the bobbin member 12 on which the correction tape 1 used is wound from the spool member 13, setting the bobbin member 12 on the holding shaft on the tape feed side, and setting another empty bobbin member 12 on the spool member 13 to assemble the take-up spool 11, differing from the conventional technique wherein the correction tape must be rewound on the tape feed bobbin from the take-up spool for reuse of the correction tape. Thus, the reuse of the correction tape can be carried out so much readily.

The above-mentioned rotational mechanisms inherent to the bobbin member as a tape feed bobbin and the take-up spool are mere examples for the purpose of demonstration thereof. Since the present invention is characterized in that the bobbin member is detachably joined with the spool member so that the relative rotation between both members is prevented, it should be understood that the present invention may be readily modified for other rotational mechanisms.

What is claimed is:

1. An assembly for dispensing and winding a typecorrection tape one or more times under the influence of the holding and rotation mechanism of a conventional correction typewriter, comprising a correction tape unit including a pair of similar hollow cylindrical bobbins, connected by means of a length of correction tape adapted to be dispensed from one bobbin which is a dispensing bobbin in normal dispensing position, and wound onto the other bobbin which is a take-up bobbin in inverted take-up position, each said bobbin comprising a machine fastening means for engaging a holding mechanism of a typewriter, when in normal dispensing position, and also comprising a spool fastening means for a take-up spool, when the bobbin is in inverted take-up position, to prevent relative rotation between said bobbin and said spool, and a said tape take-up spool comprising a shaft having a lower drive means adapted for engagement by a rotation mechanism of a typewriter and also comprising a companion means for engaging said spool fastening means of said take-up bobbin in inverted position, the said take-up bobbin being secured on the shaft of said spool by engagement of said spool fastening means and said companion means, to permit said take-up bobbin to be rotated with said spool and cause said correction tape to be unwound from the dispensing bobbin onto the take-up bobbin under the influence of the typewriter mechanism, said correction tape unit being designed to be removed from said holding means and from said take-up spool, when the correction tape has moved from the dispensing bobbin to the take-up bobbin, inverted, and reattached with the original dispensing bobbin secured in inverted position to the shaft of the spool and the original take-up bobbin secured in normal position in engagement with the holding mechanism of fhe typewriter to permit the correction tape to be dispensed another time.

2. An assembly according to claim 1 in which the fastening means of each of said hollow cylindrical bobbins comprises helical slits which extend inwardly from one end thereof to form the said means for engaging the holding mechanism of a typewriter.

3. An assembly according to claim 1 in which the engagement means on the shaft of said spool comprises a projection and the companion means on each of said bobbins comprises a groove in the internal wall thereof, open at one end, to receive said projection when said bobbins are in inverted, take-up position.

4. An assembly according to claim 1 in which the shaft of said spool comprises a lower flange which supports the inverted bobbin on said shaft above said lower drive means.

5. An assembly according to claim 4 comprising an upper flange member detachably secured to said spool, or to said inverted bobbin on said spool, to provide between said upper and lower flanges a portion of the shaft which receives the wound correction ribbon.

6. An assembly according to claim 5 in which said upper flange member comprises a boss portion having a threaded bore, and the upper end of the shaft of the spool is threaded for engagement within said bore to confine the said inverted bobbin on said shaft beneath said upper flange member.

7. An assembly according to claim 1 which further comprises an upper flange member comprising means for attachment to the said fastening means of said bobbins in inverted position, said upper flange member being attached to said fastening means of the said inverted bobbin on said spool.

8. An assembly according to claim 2 which further comprises an upper flange member having a boss portion having a helically-grooved bore therein which mates with the helical slits of each of said bobbins in inverted position, said upper flange member being attached to the said inverted bobbin on said spool by engagement of said helical slits within said bore.

* * * * *